US008197305B2

(12) United States Patent
Ido et al.

(10) Patent No.: US 8,197,305 B2
(45) **Date of Patent: *Jun. 12, 2012**

(54) DYNAMIC PRESSURE RELEASING METHOD OF GRINDING LIQUID IN GRINDING OPERATION, GRINDING METHOD USING THE RELEASING METHOD, AND GRINDING STONE FOR USE IN THE GRINDING METHOD

(75) Inventors: Masahiro Ido, Kariya (JP); Satoshi Ohyabu, Tahara (JP); Haruhiko Amakusa, Nagoya (JP); Akio Mori, Toyoto (JP)

(73) Assignee: JTEKT Corporation, Osaka-shi (JP)

( * ) Notice: Subject to any disclaimer, the term of this patent is extended or adjusted under 35 U.S.C. 154(b) by 559 days.

This patent is subject to a terminal disclaimer.

(21) Appl. No.: 12/442,627

(22) PCT Filed: Oct. 9, 2007

(86) PCT No.: PCT/JP2007/069667

§ 371 (c)(1),
(2), (4) Date: Mar. 24, 2009

(87) PCT Pub. No.: WO2008/044672

PCT Pub. Date: Apr. 17, 2008

(65) Prior Publication Data

US 2010/0041321 A1 Feb. 18, 2010

(30) Foreign Application Priority Data

Oct. 12, 2006 (JP) ..... 2006-278815

(51) Int. Cl.
*B24B 1/00* (2006.01)

(52) U.S. Cl. ..... 451/53; 451/488; 451/449

(58) Field of Classification Search ..... 451/7, 9–11, 451/49, 53, 242, 251, 488, 449, 542, 547, 451/450

See application file for complete search history.

(56) References Cited

U.S. PATENT DOCUMENTS 2,226,608 A * 12/1940 Gilmore et al. ..... 51/293

(Continued)

FOREIGN PATENT DOCUMENTS

JP 51 61578 5/1976

(Continued)

OTHER PUBLICATIONS

U.S. Appl. No. 12/443,545, filed Mar. 30, 2009, Soma, et al.

(Continued)

*Primary Examiner* — George Nguyen
(74) *Attorney, Agent, or Firm* — Oblon, Spivak, McClelland, Maier & Neustadt, L.L.P.

(57) ABSTRACT

A dynamic pressure in the coolant supplied between a rotating grinding wheel and a rotating workpiece is released by making at least one of oblique grooves on the grinding wheel pass vertically through a contact surface on which a grinding surface of the grinding wheel contacts the workpiece. Where one and the other side intersection points are defined as intersection points at which both ends of each oblique groove respectively cross extension lines of one and the other side edges parallel to a grinding wheel circumferential direction of the contact surface, the other side intersection point of each oblique groove overlaps the one side intersection point of an oblique groove next to each such oblique groove by a predetermined overlap amount in the grinding wheel circumferential direction, and the length in the grinding wheel circumferential direction of the contact surface is made to be shorter than the overlap amount.

5 Claims, 5 Drawing Sheets

U.S. PATENT DOCUMENTS

| | | | | |
|---|---|---|---|---|
| 2,987,970 | A | 6/1961 | Watson | |
| 3,132,815 | A * | 5/1964 | Wagner | 241/282.1 |
| 3,579,928 | A * | 5/1971 | Held | 451/488 |
| 3,841,034 | A * | 10/1974 | Held | 451/488 |
| 3,916,579 | A * | 11/1975 | Waller et al. | 451/547 |
| 5,052,154 | A * | 10/1991 | Lehmann | 451/542 |
| 5,611,724 | A * | 3/1997 | deGraaff | 451/53 |
| 5,833,523 | A * | 11/1998 | Hykes | 451/450 |
| 5,846,125 | A * | 12/1998 | Robichon | 451/450 |
| 5,961,381 | A * | 10/1999 | Alexeev et al. | 451/488 |
| 6,564,887 | B2 * | 5/2003 | Hong et al. | 175/395 |
| 6,669,532 | B1 * | 12/2003 | Mukai et al. | 451/7 |
| 6,840,851 | B1 * | 1/2005 | Raffaelli | 451/547 |
| 7,572,175 | B2 * | 8/2009 | Ido | 451/446 |
| 7,824,246 | B2 * | 11/2010 | Inagaki et al. | 451/9 |
| 2006/0246823 | A1 * | 11/2006 | Morita et al. | 451/7 |
| 2009/0258576 | A1 * | 10/2009 | Mizutani et al. | 451/53 |
| 2010/0041321 | A1 * | 2/2010 | Ido et al. | 451/53 |

FOREIGN PATENT DOCUMENTS

| | | |
|---|---|---|
| JP | 57 157458 | 10/1982 |
| JP | 1 125167 | 8/1989 |
| JP | 09-150371 | 6/1997 |
| JP | 2002-036123 | 2/2002 |
| JP | 2002 66931 | 3/2002 |
| JP | 2003 39334 | 2/2003 |
| JP | 2003-291071 | 10/2003 |
| JP | 2006 88291 | 4/2006 |

OTHER PUBLICATIONS

U.S. Appl. No. 12/421,063, filed Apr. 9, 2009, Mizutani, et al.

Japanese Office Action mailed Feb. 14, 2012 for JP. Application No. 2006-278815 filed Oct. 12, 2006 (with English translation).

* cited by examiner

DYNAMIC PRESSURE RELEASING METHOD OF GRINDING LIQUID IN GRINDING OPERATION, GRINDING METHOD USING THE RELEASING METHOD, AND GRINDING STONE FOR USE IN THE GRINDING METHOD

TECHNOLOGICAL FIELD

The present invention relates to a grinding operation for grinding a workpiece with a grinding wheel with coolant supplied toward a contact surface on a grinding surface of the grinding wheel and the workpiece.

BACKGROUND ART

Heretofore, in grinding a workpiece with a grinding wheel, grinding burn, thermal stress and the like of the workpiece caused by the grinding heat are prevented by supplying coolant toward a grinding point between the workpiece and the grinding wheel for cooling and lubrication. However, where a superfluous volume of coolant is supplied toward the grinding point between the workpiece and the grinding wheel, a dynamic pressure is generated in the coolant between the workpiece and the grinding wheel. In particular, where the workpiece has a hole or groove, the same causes the dynamic pressure to fluctuate, which gives rises to a problem that the machining accuracy of the workpiece is deteriorated due to a relative displacement between the workpiece and grinding wheel. Patent Document 1 discloses a technology for preventing the machining accuracy from being deteriorated due to such a dynamic pressure generated in the coolant. In the technology described in the Patent Document 1, there is provided a coolant supply device capable of switching into two high and low steps the pressure of coolant supplied to a coolant nozzle which supplies coolant toward a grinding point at which the grinding wheel contacts a workpiece. The coolant pressure is switched into a high pressure during a rough grinding wherein the feed rate of the grinding wheel toward the workpiece is high, but into a low pressure during a finish grinding wherein the feed rate is low, as well as during a spark-out grinding. Thus, the machining accuracy is prevented from being deteriorated due to the dynamic pressure generated in coolant.

Patent Document 1: Japanese Utility Model Application No. 57-157458 (pages 1-3 and FIG. 2)

DISCLOSURE OF THE INVENTION

Problem to be Solved by the Invention

In the prior art described above, it is impossible to release the dynamic pressure which is generated in the coolant supplied to a contact surface on which the grinding surface of the grinding wheel contacts the workpiece. In particular, where the rotational speeds of the grinding wheel and the workpiece are increased to heighten the grinding efficiency, the dynamic pressure generated in the coolant causes the machining accuracy to be deteriorated. For desired machining accuracy, it has to be done to lower the rotational speeds of the grinding wheel and the workpiece. This gives rises to a problem that the machining efficiency is lowered.

The present invention is intended to heighten the machining accuracy of a workpiece and to improve the grinding efficiency by making at least one oblique groove pass through a contact surface on which a grinding wheel contacts a workpiece, in a vertical direction to release a dynamic pressure generated in the coolant supplied toward the contact surface.

Measures for Solving the Problem

In order to solve the aforementioned problem, the features in construction of the invention in a first aspect resides in a coolant dynamic pressure releasing method in a grinding operation, of releasing a dynamic pressure generated between a grinding surface of a rotating grinding wheel and a rotating workpiece in grinding the workpiece with the grinding wheel with coolant supplied toward a contact surface on which the grinding surface contacts the workpiece, wherein a plurality of oblique grooves inclined at a predetermined angle relative to a grinding wheel circumferential direction are formed on the grinding surface at an equiangular interval and in such an arrangement that where one side intersection point is defined as an intersection point of each oblique groove and an extension line of one side edge parallel to the grinding wheel circumferential direction of the contact surface and the other side intersection point is defined as an intersection point of each oblique groove and an extension line of the other side edge, each oblique groove, in a portion thereof between the one side intersection point and the other side intersection point, overlaps an oblique groove next to each such oblique groove, in a portion thereof between the one side intersection point and the other side intersection point, by a predetermined overlap amount in the grinding wheel circumferential direction, and wherein the infeed amount of the grinding wheel against the workpiece is set so that the length in the grinding wheel circumferential direction of the contact surface becomes shorter than the overlap amount.

The features in construction of the invention in a second aspect resides in a grinding method utilizing the coolant dynamic pressure releasing method in the first aspect, wherein the grinding is performed with such an infeed amount of the grinding wheel against the workpiece that the length in the grinding wheel circumferential direction of the contact surface becomes shorter than the overlap amount.

The features in construction of the invention in a third aspect resides in a grinding wheel used in a grinding method utilizing the dynamic pressure releasing method in the first aspect, wherein the oblique grooves are formed on the grinding surface at such an inclination angle and an interval that with respect to the predetermined infeed amount of the grinding wheel against the workpiece, the length in the grinding wheel circumferential direction of the contact surface becomes shorter than the overlap amount.

The features in construction of the invention in the fourth aspect resides in that in the coolant dynamic pressure releasing method in the first aspect, the workpiece is a cam including a base circle portion, a top portion and a pair of lift portions connecting the base circle portion with the top portion, and the length in the grinding wheel circumferential direction of the contact surface is set as the length in the grinding wheel circumferential direction of the contact surface in grinding each of the lift portions.

Effects of the Invention

With the invention in the first aspect, where in the grinding operation for grinding the workpiece with coolant supplied toward the contact surface on which the grinding surface of the grinding wheel contacts the workpiece, one side intersection point is defined as the intersection point of each oblique groove formed on the grinding surface and the extension line of one side edge parallel to the grinding wheel circumferential direction of the contact surface and the other side intersection point is defined as the intersection point of each oblique groove and the extension line of the other side edge, each oblique groove, in the portion thereof between the one side intersection point and the other side intersection point, overlaps an oblique groove next to each such oblique groove, in the portion thereof between the one side intersection point and the other side intersection point, by the predetermined overlap amount in the grinding wheel circumferential direction, and the length in the grinding wheel circumferential direction of the contact surface is made to be shorter than the overlap amount. Thus, at least one oblique groove vertically passes through the contact surface on which the grinding surface of the grinding wheel contacts the workpiece, so that the dynamic pressure which the coolant flowing onto the contact surface generates between the grinding surface and the workpiece can be released from both of upper and lower sides of the contact surface. Accordingly, without decreasing the supply quantity of coolant during a finish grinding, it can be prevented that the dynamic pressure in coolant causes the workpiece to be displaced in a direction away from the grinding wheel or the distance which the workpiece goes away from the grinding wheel varies upon fluctuations in the dynamic pressure generated in coolant. As a result, it becomes possible to heighten the machining accuracy of the workpiece and to improve the grinding efficiency.

With the invention in the second aspect, since the grinding is performed with such an infeed amount of the grinding wheel against the workpiece that the length in the grinding wheel circumferential direction of the contact surface becomes shorter than the overlap amount of the adjoining oblique grooves, at least one oblique groove vertically passes through the contact surface on which the grinding surface of the grinding wheel contacts the workpiece. Thus, the dynamic pressure which the coolant flowing onto the contact surface generates between the grinding surface and the workpiece can be released from both of upper and lower sides of the contact surface.

With the invention in the third aspect, since the oblique grooves are formed on the grinding surface at such an inclination angle and an interval that with respect to the predetermined infeed amount of the grinding wheel against the workpiece, the length in the grinding wheel circumferential direction of the contact surface becomes shorter than the overlap amount of the adjoining oblique grooves, at least one oblique groove vertically passes through the contact surface on which the grinding surface of the grinding wheel contacts the workpiece. Thus, the dynamic pressure which the coolant flowing onto the contact surface generates between the grinding surface and the workpiece can be released from both of upper and lower sides of the contact surface.

With the invention in the fourth aspect, since the length in the grinding wheel circumferential direction of the contact surface on the grinding surface of the grinding wheel and each lift portion becomes the longest when each lift portion is ground, the longest length in the grinding wheel circumferential direction is made to be shorter than the overlap amount of the adjoining oblique grooves. Thus, at least one oblique groove vertically passes through the contact surface on which the grinding surface of the grinding wheel contacts the workpiece, so that the dynamic pressure which the coolant flowing onto the contact surface generates between the grinding surface and the workpiece can be released from both of the upper and lower sides of the contact surface. Accordingly, without decreasing the supply quantity of coolant during a finish grinding, it can be prevented that the dynamic pressure in coolant causes the cam to be displaced in a direction away from the grinding wheel or the distance which the cam goes away from the grinding wheel varies upon fluctuations in the dynamic pressure generated in coolant. As a result, it becomes possible to heighten the machining accuracy of the workpiece and to improve the grinding efficiency.

DESCRIPTION OF REFERENCE SYMBOLS

10 . . . grinding wheel, 11 . . . wheel chips, 12 . . . abrasive grain layer, 13 . . . foundation layer, 14 . . . core, 15 . . . grinding surface, 16 . . . superabrasive grains, 17 . . . vitrified bond, 20 . . . oblique grooves, 21, 22 . . . side surfaces, 23, 24 . . . extension lines, 30 . . . grinding machine, 31 . . . wheel head, 32 . . . wheel spindle, 33 . . . workpiece support device, 35 . . . coolant nozzle, S . . . contact surface, W . . . workpiece, W1 . . . lift portions, α . . . inclination angle, L . . . length in circumferential direction, P . . . pitch (interval) in circumferential direction.

PREFERRED EMBODIMENT FOR PRACTICING THE INVENTION

Figure 1:
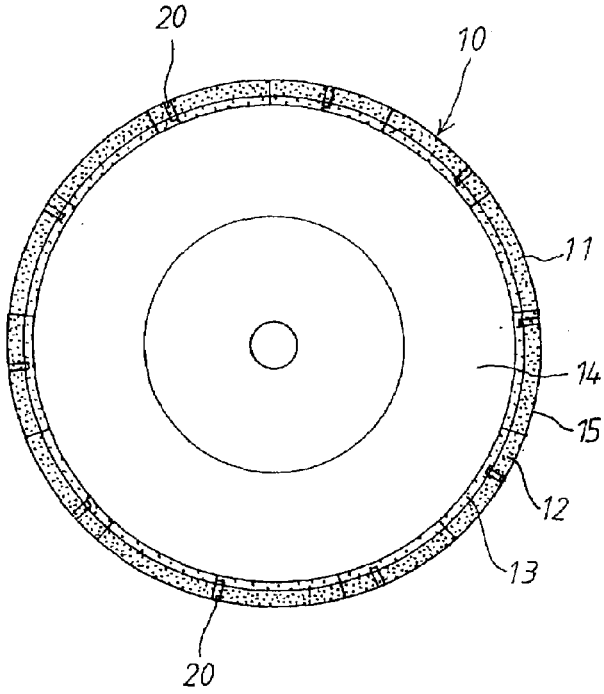
FIG. 1 is a general view composed of segmented wheel chips showing an embodiment according to the present invention.
Figure 2:
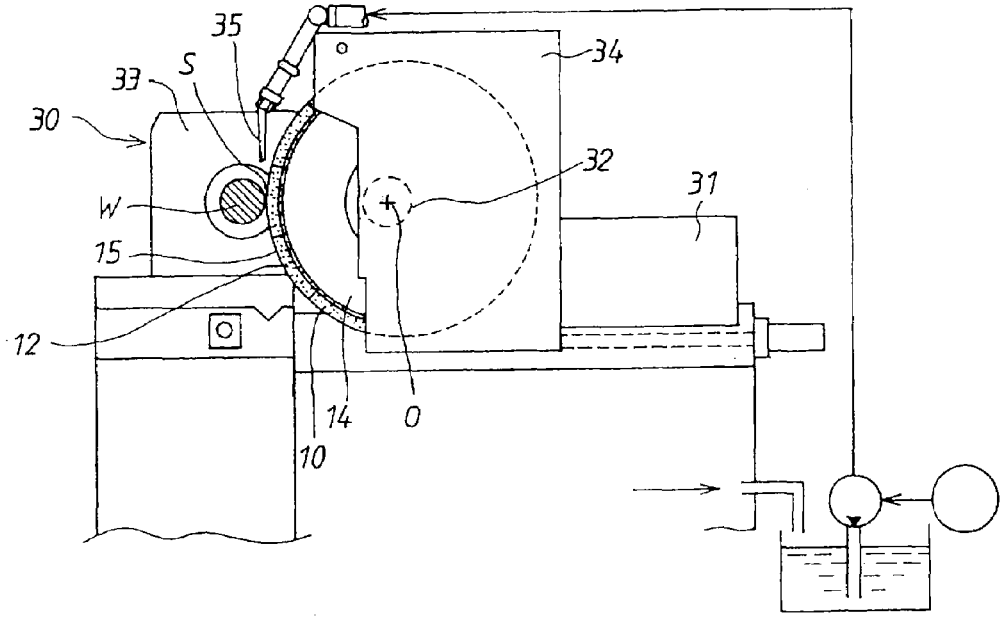
FIG. 2 is a view showing the state that a workpiece is ground in a grinding machine having attached an obliquely grooved grinding wheel.

Hereafter, a grinding method and a grinding wheel used in the same in an embodiment according to the present invention will be described with reference to the drawings. FIG. 1 shows a grinding wheel 10 including segmented wheel chips 11. In each wheel chip 11 of the grinding wheel 10, an abrasive grain layer 12 in which superabrasive grains are bonded with a vitrified bond is formed on the outer side, and a foundation layer 13 which does not contain superabrasive grains is bodily formed to be placed on the inner side of the abrasive grain layer 12. The grinding wheel 10 is configured so that a plurality of arc-shaped wheel chips 11 each composed of the abrasive grain layer 12 and the foundation layer 13 are arranged on a circumferential surface of a disc-like core 14 made of a metal such as iron, aluminum or the like, a resin or the like and are adhered by an adhesive to the core 14 at bottom surfaces of the foundation layers 13. The grinding wheel 10 is attached at the core 14 to a wheel spindle 32 which is carried by a wheel head 31 of a grinding machine 30 shown in FIG. 2, to be drivingly rotatable about an axis O. A workpiece W is drivingly rotatably supported by a workpiece support device 33 of the grinding machine 30. The advance movement of the wheel head 31 brings a grinding surface 15 formed on the abrasive grain layer 12 of the grinding wheel 10, into contact with the workpiece W at a contact surface S, so that the outer surface of the workpiece W is ground.

Figure 3:
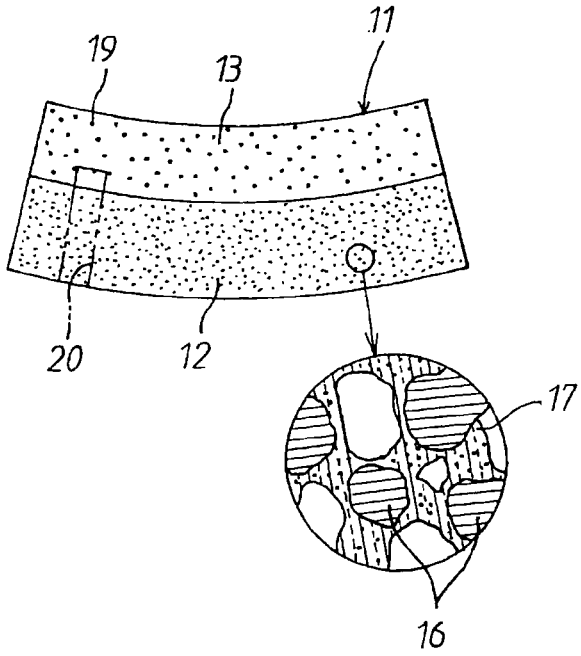
FIG. 3 is a view showing a wheel chip.

FIG. 3 shows the arc-shaped wheel chip 11, the abrasive grain layer 12 of which is configured by bonding with a vitrified bond 17 the superabrasive grains 16 such as CBN, diamond or the like to the depth of 3 to 5 mm. It may be the case that particles such as aluminum oxide ($Al_2O_3$) or the like which replace those of superabrasive grains are mixed as aggregate into the abrasive grain layer 12 for adjustment of concentration. Further, the foundation layer 13 is configured by bonding foundation particles 19 with the vitrified bond 17 to the depth of 1 to 3 mm. Because with the use of the vitrified bond 17, the property being porous improves the capability of discharging grinding chips thereby to enhance the sharpness, the grinding can be performed at an excellent accuracy of surface roughness and in a little quantity of the grinding wheel wear. However, as bond material, a resin bond, a metal bond or the like may be used instead of the vitrified bond 17.

Figure 4:
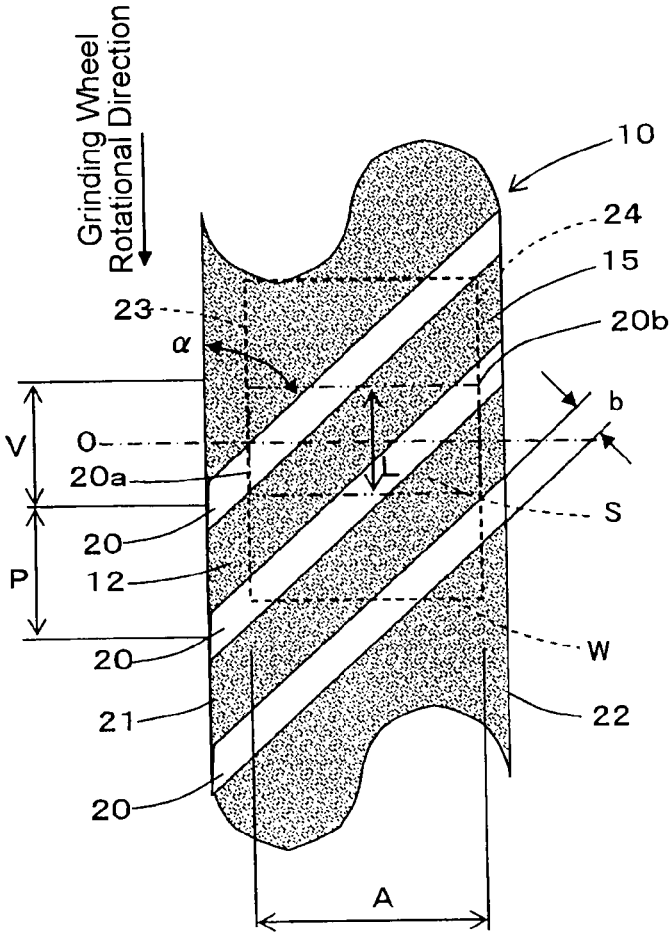
FIG. 4 is a view showing a grinding surface 15 of the grinding wheel in a developed form.
Figure 5:
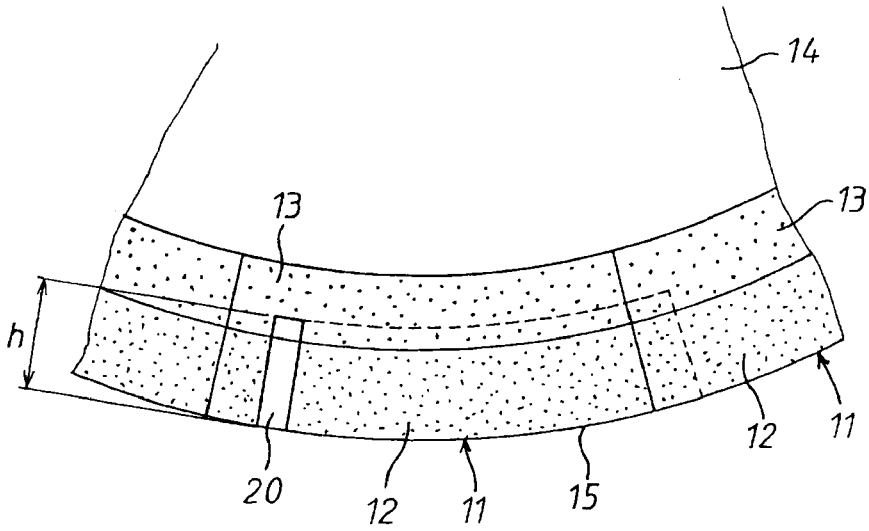
FIG. 5 is a view showing the state that the oblique grooves are formed in an abrasive grain layer.
Figure 6:
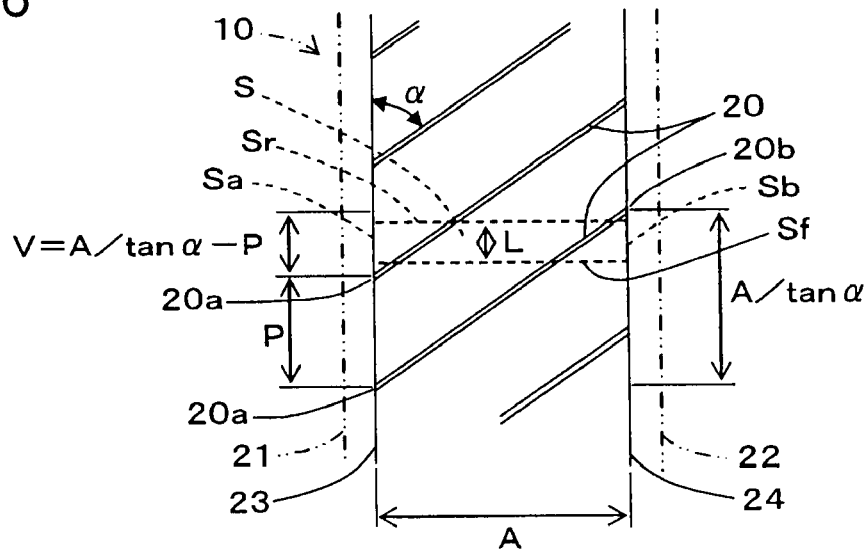
FIG. 6 is an illustration showing the relations between an overlap amount, an inclination angle α and a pitch P in the circumferential direction of the oblique grooves and an axial length A of a contact surface S.

As shown in FIGS. 4 through 6, the grinding surface 15 of the grinding wheel 10 is provided thereon with a plurality of oblique grooves 20, which enter one side and come out the other side of both side surfaces 21, 22 parallel to the grinding wheel circumferential direction of the abrasive grain layer 12 at a depth h from the grinding surface 15 to reach the foundation layer 13. That is, on the grinding surface 15, the plurality of oblique grooves 20 which are inclined by a predetermined inclination angle α relative to the grinding wheel circumferential direction are formed at an equiangular interval and in such an arrangement that where one side intersection point 20*a* is defined as an intersection point of each oblique groove 20 and an extension line 23 of one side edge Sa parallel to the grinding wheel circumferential direction of the contact surface S and the other side intersection point 20*b* is defined as an intersection point of each oblique groove 20 and an extension line 24 of the other side edge Sb, each oblique groove 20, in the portion thereof between the one side intersection point and the other side intersection point, overlaps an oblique groove 20 next to each such oblique groove 20, in the portion thereof between the one side intersection point and the other side intersection point, by an overlap amount V in the grinding wheel circumferential direction. In other words, the plurality of oblique grooves 20 inclined by the predetermined angle α are formed on the grinding surface 15 at the equiangular interval to open at both sides of the grinding wheel 10 so that a part of each oblique groove 20 on one side of the grinding wheel 20 overlaps a part of a circumferentially adjoining oblique groove 20 (i.e., an oblique groove 20 next to each such oblique groove 20) on the other side of the grinding wheel 20 by the predetermined overlap amount V in the grinding wheel circumferential direction. Then, the infeed amount t of the grinding wheel 10 against the workpiece W and at least one of the inclination angle α and the interval P of the oblique grooves 20 are set so that the length L in the grinding wheel circumferential direction of the contact surface S on the grinding surface 15 of the grinding wheel 10 and the workpiece W becomes shorter than the overlap amount V. The contact surface S is an area on the grinding surface 15 of the grinding wheel 10 which area is partitioned by the intersection points at which the outer circle of the grinding wheel 10 crosses the outer circle of the workpiece W, and the width A of the workpiece W. The contact surface S is surrounded by the one side edge Sa and the other side edge Sb which extend in parallel to the grinding wheel circumferential direction, and one side edge Sf and the other side edge Sr which extend in parallel to the grinding wheel axis direction.

Since the length L in the grinding wheel circumferential direction of the contact surface S on the grinding surface 15 of the grinding wheel 10 and the workpiece W is made to be shorter than the overlap amount V, coolant supplied from the upside onto the contact surface S flows out from the upper and lower sides through the oblique grooves 20 crossing the contact surface S, whereby a dynamic pressure in coolant generated between the grinding surface 15 and the workpiece W can be released. Thus, it can be prevented that the dynamic pressure in coolant causes the workpiece W to be displaced in a direction away from the grinding wheel 10 or the distance which the workpiece W goes away from the grinding wheel 10 varies upon fluctuations in the dynamic pressure generated in coolant. As a result, it becomes possible to enhance the accuracy of the ground workpiece W.

As is clear from FIGS. 4 and 6 in which the grinding surface 15 of the grinding wheel 10 is shown in a developed form, the following relation holds between the overlap amount V by which each oblique groove 20, in the portion thereof between the one side intersection point and the other side intersection point, overlaps an oblique groove 20 next to each such oblique groove 20, the inclination angle α of the oblique grooves 20, the interval P of the adjoining oblique grooves 20, e.g., the pitch in the circumferential direction, and the width A of the workpiece W represented by the axial length of the contact surface S.

$$V=A/(\tan\alpha-P) \quad (1)$$

Therefore, where the following condition in which the length L in the circumferential direction of the contact surface S is shorter than the overlap amount V is satisfied, $$L<A/(\tan\alpha-P) \quad (2)$$

it can be realized that at least one oblique groove 20 vertically passes through the contact surface S independently of the rotational phase of the grinding wheel 10. As a result, it becomes possible to release the dynamic pressure which the coolant flowing onto the contact surface S generates between the grinding surface 15 and the workpiece W, from both of the upper and lower sides of the contact surface S. Where the condition is not satisfied, on the contrary, it takes place in dependence on the rotational phase of the grinding wheel 10 that none of the oblique grooves 20 vertically passes through the contact surface S. That is, when the oblique groove 20 opens only on the upper side of the contact surface S, the dynamic pressure cannot be released on the lower side of the contact surface S. Likewise, when the oblique groove 20 opens only on the lower side of the contact surface S, the dynamic pressure in the coolant cannot be released on the upper side of the contact surface S.

Figure 7A:
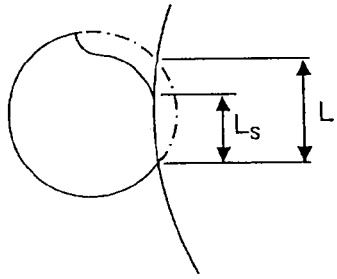
FIGS. 7(*a*)-7(*c*) are illustrations showing the length in the circumferential direction of the contact surface.
Figure 7B:
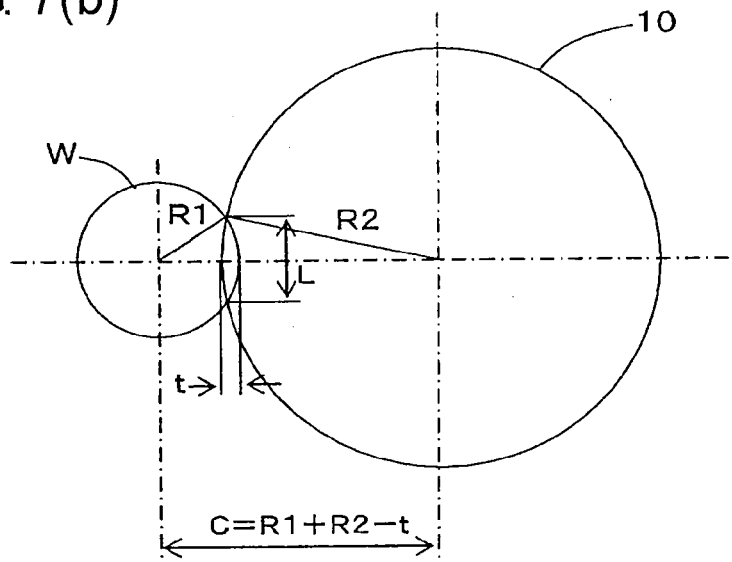
Figure 7C:
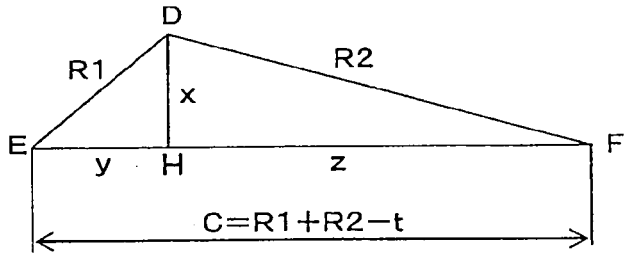

As shown in FIG. 7(*b*), the length L in the grinding wheel circumferential direction of the contact surface S on which the grinding wheel 10 contacts the workpiece W is taken as the length of a line segment connecting intersection points at each of which the outer circle of the grinding wheel 10 crosses the outer circle of the workpiece W. Since the length L in the grinding wheel circumferential direction of the contact surface S is extremely short in comparison with the diameters of the grinding wheel 10 and the workpiece W, it can be approximated by the length of the line segment connecting the intersection points at each of which the outer circle of the grinding wheel 10 crosses the outer circle of the workpiece W.

Taking the radius of the workpiece W as R1, the radius of the grinding wheel 10 as R2 and the infeed amount of the grinding wheel 10 against the workpiece W as t, as shown in FIG. 7(*c*), the center-to-center distance C between the workpiece W and the grinding wheel 10 is expressed as follows:

$$C=R1+R2-t \quad (3)$$

Taking as D the intersection point at which the outer circle of the grinding wheel 10 crosses the outer circle of the workpiece W, as EF a line segment connecting the center E of the workpiece W with the center F of the grinding wheel 10 and as H a point at which a line segment coming from the intersection point D downward to line segment EF crosses the line segment EF at the right angle, and further taking the lengths of the line segments DH, EH and FH respectively as x, y and z, the following relations hold.

$$R1^2=x^2+y^2 \quad (4)$$

$$R2^2=x^2+z^2 \quad (5)$$

$$\text{Since } C=y+z\text{, then there holds } y^2=(C-z)^2 \quad (6)$$

Solving the expressions (4), (5) and (6) for x, there holds:

$$x=\sqrt{(R2^2-((C^2+R2^2-R1^2)/2C)^2)} \quad (7)$$

Then, the length L in the circumferential direction of the contact surface S on which the grinding wheel 10 contacts the workpiece W is:

$$L=2x \quad (8)$$

Where the length L in the circumferential direction of the contact surface S is equal to the overlap amount V, there comes L=2x=V=A/(tan α−P) from the expressions (1) and (8), and the infeed amount t in this case becomes:

$$t0=R1+R2-\sqrt{(R1^2-(A/(\tan\alpha-P)/2)^2)}-\sqrt{(R2^2-(A/(\tan\alpha-P)/2)^2)} \quad (9)$$

Therefore, where determinations have been made regarding the radii R1, R2 of the workpiece W and the grinding wheel 10, the width A of the workpiece W, the inclination angle α of the oblique grooves 20 and the pitch P in the circumferential direction, the length L in the circumferential direction of the contact surface S becomes shorter than the overlap amount V by setting the infeed amount t of the grinding wheel 10 against the workpiece W to be smaller than t0.

Further, where determinations have been made regarding the radii R1, R2 of the workpiece W and the grinding wheel 10, the width A of the workpiece W, the infeed amount t of the grinding wheel 10 against the workpiece W and one of the inclination angle α of the oblique grooves 20 and the pitch P in the circumferential direction, as the expression (9) holds, the length L in the circumferential direction of the contact surface S becomes shorter than the overlap amount V by setting the other of the inclination angle α0 of the oblique grooves 20 and the pitch P0 in the circumferential direction and by setting the pitch P in the circumferential direction or the inclination angle α to be smaller than the pitch P0 in the circumferential direction or the inclination angle α0 which is so set. The number n of the oblique grooves 20 set in this way becomes n=2π×R2/P.

Next, description will be made regarding a method of grinding the workpiece W with the grinding wheel 10 in the present embodiment. The grinding wheel 10 is drivingly rotated with the core 14 attached to the wheel spindle 32 which is rotatably supported by the wheel head 31 of the grinding machine 30 shown in FIG. 2, while the workpiece W is drivingly rotated with itself supported by the workpiece support device 33 composed of a work head and a foot stock. Coolant is supplied from a coolant nozzle 35 attached to a wheel cover 34, toward the contact surface S between the grinding surface 15 of the grinding wheel 10 and the workpiece W. The wheel head 31 is fed toward the workpiece W, whereby the workpiece W is ground with the grinding wheel 10. At this time, since at least one oblique groove 20 passes through the contact surface S in the vertical direction independently of the rotational phase of the grinding wheel 10, a dynamic pressure in the coolant generated between the grinding surface 15 and the workpiece W can be released from the upper and lower sides of the contact surface S. Accordingly, it can be prevented that the dynamic pressure in coolant causes the workpiece W to be displaced in a direction away from the grinding wheel or the distance which the workpiece W goes away from the grinding wheel 10 varies upon fluctuations in the dynamic pressure generated in coolant. Thus, it becomes possible to heighten the machining accuracy of the workpiece W.

Figure 8A:
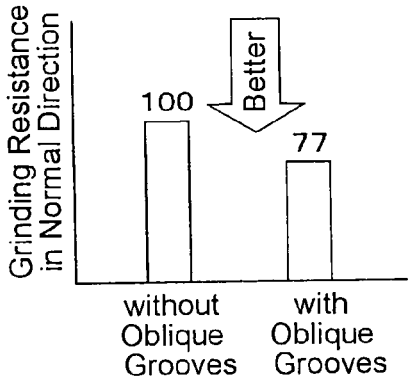
FIGS. 8(*a*) and 8(*b*) are graphs demonstrating the rates at which the obliquely grooved grinding wheel improves the grinding resistance in the normal direction and the profile accuracy.
Figure 8B:
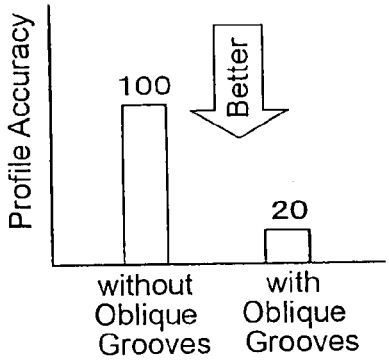

One example of the grinding operation using the obliquely grooved grinding wheel 10 will be described in comparison with that using a grinding wheel with no oblique grooves thereon. For a comparative grinding operation, there was used a grinding wheel of 350 mm in outer diameter wherein the abrasive grain layers 12 were formed by bonding CBN abrasive grains of #120 in grain size with the vitrified bond 17 in the concentration of 150 and wherein the wheel chips 11 were formed by bodily placing the foundation layers 13 with no superabrasive grains contained therein, on the inner sides of the abrasive grain layers 12 and were adhered to the steel core 14. By the use of the grinding wheel with no oblique grooves thereon, hardened steel cams (workpieces W) of 15 mm in width were ground, in which case each of the grinding resistance in the normal direction and the profile accuracy in the grinding operation was determined as "100" being a reference for comparison. In one example of the grinding operation in the present embodiment, the obliquely grooved grinding wheel 10 was used wherein thirty-nine oblique grooves 20 each being 1 mm in the groove width b, 6 mm in the groove depth h and 15 degrees in the inclination angle α were grooved on the circumferential grinding surface 15 of the aforementioned grinding wheel. By the use of the obliquely grooved grinding wheel 10, cams of the same kind as above were ground, in which case the result was that the grinding resistance in the normal direction decreased to "77" and that the profile accuracy was improved to "20" (refer to FIGS. 8(*a*) and 8(*b*)).

Figure 9:
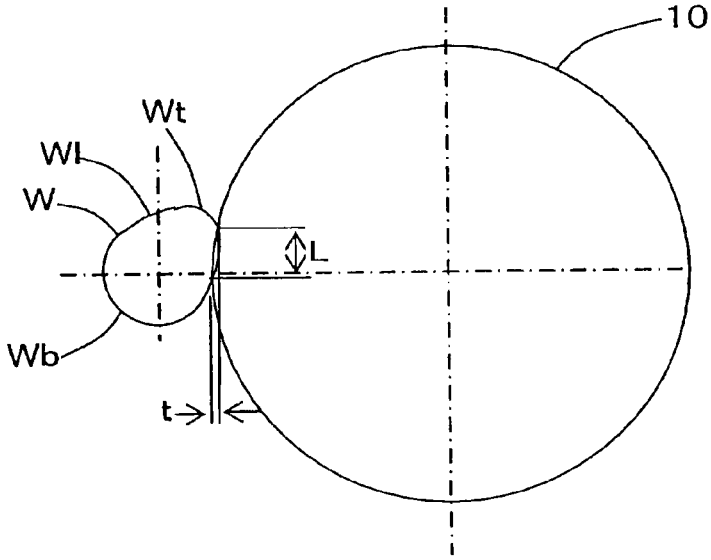
FIG. 9 is an illustration showing a contact surface on the grinding wheel and a side portion of a cam.

In grinding a cam which includes a base circle portion Wb, a top portion Wt and a pair of lift portions Wl connecting the base circle portion Wb with the top portion Wt, as shown in FIG. 9, the length in the circumferential direction of the contact surface S with the grinding wheel 10 becomes the longest because the lift portions Wl of the cam are small in curvature. As the length in the circumferential direction of the contact surface S becomes long like this, the dynamic pressure in the coolant supplied toward the contact surface S increases. However, by making the overlap amount V of the adjoining oblique grooves 20 longer than the longest length in the grinding wheel circumferential direction, at least one oblique groove 20 is made to pass through the contact surface S in the vertical direction independently of the rotational phase of the grinding wheel 10, and thus, it can be realized to release the dynamic pressure which the coolant generates between the grinding surface and the workpiece, from the upper and lower sides of the contact surface S. Accordingly, without decreasing the supply quantity of coolant during a finish grinding, it can be prevented that the dynamic pressure in coolant causes the cam to be displaced in a direction away from the grinding wheel or the distance which the cam goes away from the grinding wheel varies upon fluctuations in the dynamic pressure generated in coolant, and as a result, it becomes possible to enhance the machining accuracy of the cam and to improve the grinding efficiency.

The foregoing embodiment is exemplified as the case that the width of the workpiece W is narrower than the width of the grinding wheel 10, in which case the specifications of the oblique grooves 20 are determined on the assumption that the axial length of the contact surface S is equal to the width A of the workpiece W. However, in the case that the width A of the workpiece W is wider than the width of the grinding wheel 10, the specifications of the oblique grooves 20 may be determined on the assumption that the axial length of the contact surface S is equal to the width of the grinding wheel.

In the foregoing embodiment, the length L in the grinding wheel circumferential direction of the contact surface S is approximated by the length of the line segment connecting the intersection points at which the outer circle of the grinding wheel 10 crosses the outer circle of the workpiece W. However, when the workpiece W is being drivingly rotated with the grinding wheel 10 infed by an infeed amount t against the workpiece W, strictly speaking, the infeed of the grinding wheel 10 against the workpieces W changes the actual length in the grinding wheel circumferential direction of the contact surface S to Ls, as shown in FIG. 7(*a*), and therefore, the length in the grinding wheel circumferential direction of the contact surface S may be determined as $Ls<L=A/\tan\alpha-P$.

INDUSTRIAL APPLICABILITY

The grinding method and the grinding wheel used in the method according to the present invention are suitable for use in a grinding operation wherein a workpiece is ground precisely by releasing a dynamic pressure which is generated in the coolant supplied to a grinding point, through a plurality of oblique grooves which are formed on a grinding surface at an equiangular interval to be inclined by a predetermined angle relative to the grinding wheel circumferential direction.

The invention claimed is:

1. A coolant dynamic pressure releasing method in a grinding operation, comprising the steps of:

grinding a workpiece by rotating the workpiece and infeeding a rotating grinding wheel against the rotating workpiece such that a grinding surface of the grinding wheel contacts the workpiece to define a contact surface where the grinding wheel contacts the workpiece, wherein the grinding surface of the grinding wheel comprises a plurality of oblique grooves inclined by a predetermined angle relative to a grinding wheel circumferential direction, at an equiangular interval, wherein where one side intersection point is defined as an intersection point of each oblique groove and an extension line of one side edge of the contact surface parallel to the grinding wheel circumferential direction and the other side intersection point is defined as an intersection point of each oblique groove and an extension line of the other side edge of the contact surface, each oblique groove, in a portion thereof between the one side intersection point and the other side intersection point, overlaps an oblique groove next to each such oblique groove, in a portion thereof between the one side intersection point and the other side intersection point, by a predetermined overlap amount in the grinding wheel circumferential direction;

supplying coolant toward the contact surface; and infeeding the grinding wheel against the workpiece by an amount such that the length, in the grinding wheel circumferential direction, of the contact surface becomes shorter than the overlap amount.

2. A grinding method utilizing the coolant dynamic pressure releasing method as set forth in claim 1, wherein:

the grinding is performed with such an infeed amount of the grinding wheel against the workpiece that the length in the grinding wheel circumferential direction of the contact surface becomes shorter than the overlap amount.

3. A grinding wheel used in a grinding method utilizing the coolant dynamic pressure releasing method as set forth in claim 1, wherein:

infeed amount of the grinding wheel against the workpiece is such that the length in the grinding wheel circumferential direction of the contact surface becomes shorter than the overlap amount.

4. The coolant dynamic pressure releasing method as set forth in claim 1, wherein:

the workpiece is a cam including a base circle portion, a top portion and a pair of lift portions connecting the base circle portion with the top portion; and the length in the grinding wheel circumferential direction of the contact surface is the length in the grinding wheel circumferential direction of the contact surface in grinding each of the lift portions.

5. A coolant dynamic pressure releasing method in a grinding operation, comprising the steps of:

grinding a workpiece by rotating the workpiece and infeeding a rotating grinding wheel against the rotating workpiece such that a grinding surface of the grinding wheel contacts the workpiece to define a contact surface where the grinding wheel contacts the workpiece, wherein the grinding surface of the grinding wheel comprises a plurality of oblique grooves inclined by a predetermined angle relative to a grinding wheel circumferential direction at an equiangular interval to open at both sides of the grinding wheel so that a part of each oblique groove on one side of the grinding wheel overlaps a part of a circumferentially adjoining oblique groove on the other side of the grinding wheel by a predetermined overlap amount in the grinding wheel circumferential direction;

supplying coolant toward the contact surface; and infeeding the grinding wheel against the workpiece by an amount such that the length, in the grinding wheel circumferential direction, of the contact surface is shorter than the overlap amount.

* * * * *